US007438590B1

(12) United States Patent
Liang et al.

(10) Patent No.: US 7,438,590 B1
(45) Date of Patent: Oct. 21, 2008

(54) ELECTRICAL CONNECTOR HAVING INSULATIVE HOUSING AND FLEXIBLE BUS

(75) Inventors: Shih-Chieh Liang, Taoyuan (TW); Wang-Kun Tsai, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 11/905,438

(22) Filed: Oct. 1, 2007

(30) Foreign Application Priority Data

Mar. 30, 2007 (TW) ..... 96111530 A

(51) Int. Cl.
*H01R 12/24* (2006.01)

(52) U.S. Cl. ..... 439/495; 439/607

(58) Field of Classification Search ..... 439/495, 439/497, 492, 607, 579
See application file for complete search history.

(56) References Cited

U.S. PATENT DOCUMENTS 5,980,308 A * 11/1999 Hu et al. ..... 439/497
6,305,978 B1 * 10/2001 Ko et al. ..... 439/579
6,619,985 B1 * 9/2003 Ko ..... 439/607
6,648,668 B1 * 11/2003 Ko ..... 439/353
6,793,527 B2 * 9/2004 Noro ..... 439/579
6,840,792 B1 * 1/2005 Kuan ..... 439/404
7,052,327 B2 * 5/2006 Ko ..... 439/660
7,189,105 B2 * 3/2007 Takaku et al. ..... 439/497
7,223,120 B2 * 5/2007 Ko ..... 439/492
7,311,552 B1 * 12/2007 Ko ..... 439/579

* cited by examiner

*Primary Examiner*—Hae Moon Hyeon
(74) *Attorney, Agent, or Firm*—Rosenberg, Klein & Lee

(57) ABSTRACT

An electrical connector includes an insulative housing receiving a plurality of terminals therein, an upper cover mounted on the insulative housing, a flexible bus, and a casing shielding the upper cover and fixed to the insulative housing. The insulative housing has a mating portion for mating with a mating connector. The flexible bus has a plurality of contacts on an end thereof. The upper cover presses against the flexible bus in assembly, forcing the contacts to contact the terminals. The casing biases against the upper cover, forcing the contacts of the flexible bus to contact the terminals reliably. The flexible bus of the electrical connector does not contact a mating connector directly, thereby lengthening the life of the flexible bus even after repeated plugging.

9 Claims, 9 Drawing Sheets

ELECTRICAL CONNECTOR HAVING INSULATIVE HOUSING AND FLEXIBLE BUS

BACKGROUND OF THE INVENTION

1. Field of the Invention

The present invention relates to an electrical connector, and particularly to an electrical connector with a flexible bus connected to.

2. Related Art

Low voltage Differential Systems (LVDS) have features of super high speed, low power consumption and low electromagnetic radiation, and are commonly applied to transfer signals between a Liquid Crystal Display (LCD) and a mainframe nowadays. The LVDS typically connects a flexible bus to a circuit board. In general, a LVDS connector connected with a flexible bus, for instance, a flexible bus connector module disclosed in Taiwan Patent Application No. 092130370, provides a planar structure on an end of a flexible bus for retaining to a mating connector.

Although such an LVDS connector has merits, it yet has the following deficiencies in practice. The flexible bus has contacts for contacting terminals of a mating connector. However, the flexible bus has so weak structure that tends to spoil the contacts of the flexible bus after repeated plugging. The contacts of the flexible bus cannot be positioned accurately. As a result, the flexible bus cannot be connected in high precision, and amount and position of the contacts cannot change. Moreover, such an LVDS connector cannot be grounded reliably, and therefore is apt to be influenced by complicated electromagnetic waves of the whole transmission system. An LVDS connector overcoming the defects above is desired.

SUMMARY OF THE INVENTION

Accordingly, a main object of the present invention is to provide an electrical connector which keeps a flexible bus connected thereto away from a mating connector, thereby avoiding damage of contacts of the flexible bus after repeated plugging.

Another object of the present invention is to provide an electrical connector which allows changeable amount and position of contacts for meeting various practical demands of transmission systems.

A further object of the present invention is to provide an electrical connector which improves precision of connection and yield rate.

A further object of the present invention is to provide an electrical connector adaptable to different types of flexible bus for lifting product values and enlarging application scope.

To achieve the above objects, the electrical connector according to the present invention comprises an insulative housing, an upper cover mounted on the insulative housing, a flexible bus, and a casing shielding the upper cover and fixed to the insulative housing. The insulative housing includes a mating portion for mating with a mating connector. A plurality of terminals is embedded into the insulative housing, and each terminal has a contact portion at an end thereof, and a resilient portion at another end thereof. The contact portions are retained to the mating portion. The flexible bus has a plurality of contacts on a surface of an end thereof. The upper cover presses against the flexible bus in assembly, forcing the contacts to contact the resilient portions of the terminals. The casing biases against the upper cover, forcing the contacts of the flexible bus to contact the resilient portions of the terminals.

The electrical connector according to another embodiment of the present invention comprises an insulative housing, an upper cover mounted on the insulative housing, a flexible bus, a casing shielding the upper cover and fixed to the insulative housing, and a lower metal sheet assembled to the insulative housing and below the flexible bus. The insulative housing receives a plurality of terminals therein. The flexible bus has a plurality of contacts on a surface of an end thereof, and a metal layer on another surface of the flexible bus and opposite the contacts. The upper cover presses against the flexible bus in assembly, forcing the contacts to contact the resilient portions of the terminals. The casing biases against the upper cover, forcing the contacts of the flexible bus to contact the resilient portions of the terminals. In one case, the casing forms at least a spring tongue for contacting the metal layer of the flexible bus. In another case, the lower metal sheet forms at least a resilient sheet for contacting the metal layer of the flexible bus.

DESCRIPTION OF THE PREFERRED EMBODIMENTS

Figure 1:
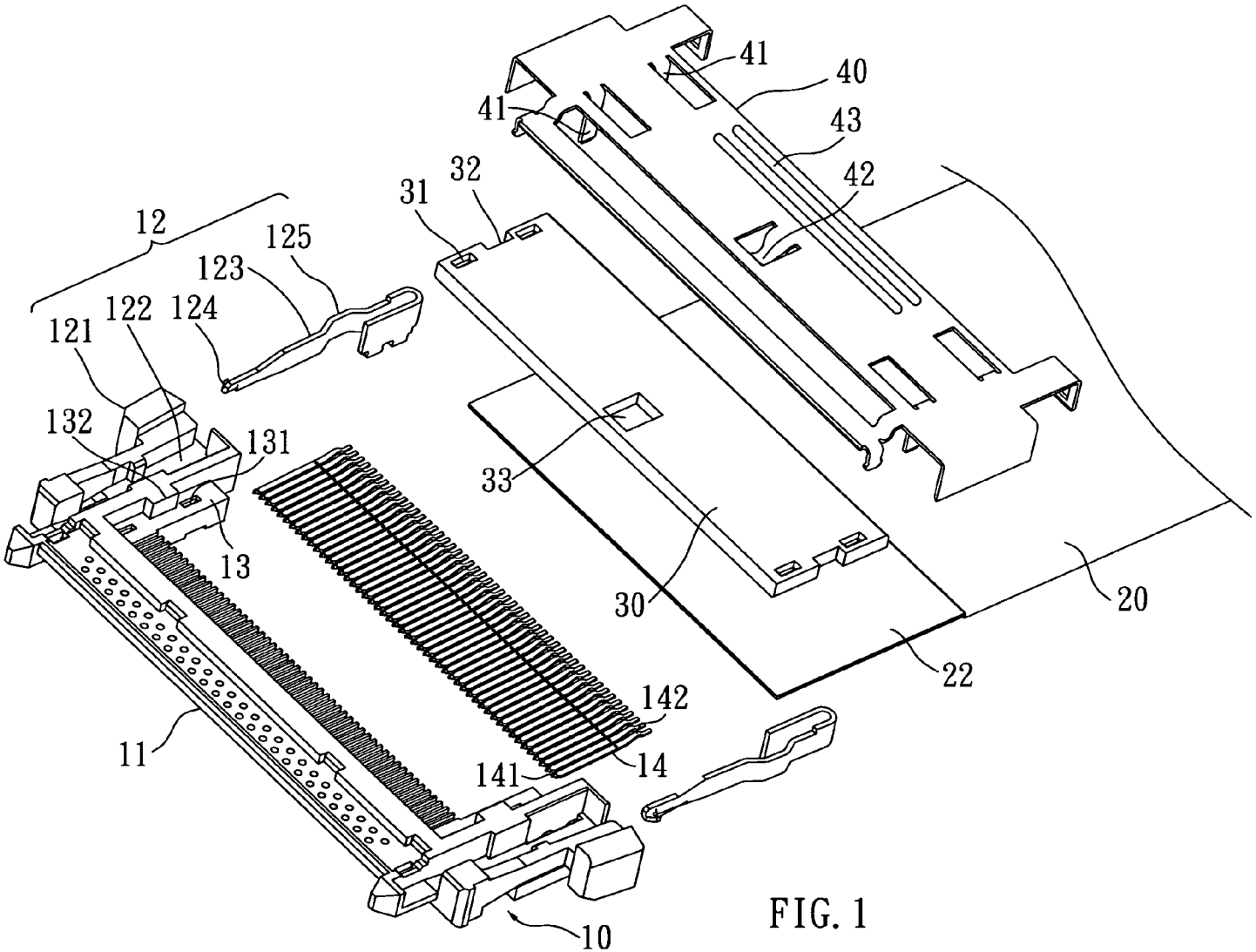
FIG. 1 is an exploded view of an electrical connector according to a first embodiment of the present invention.
Figure 2:
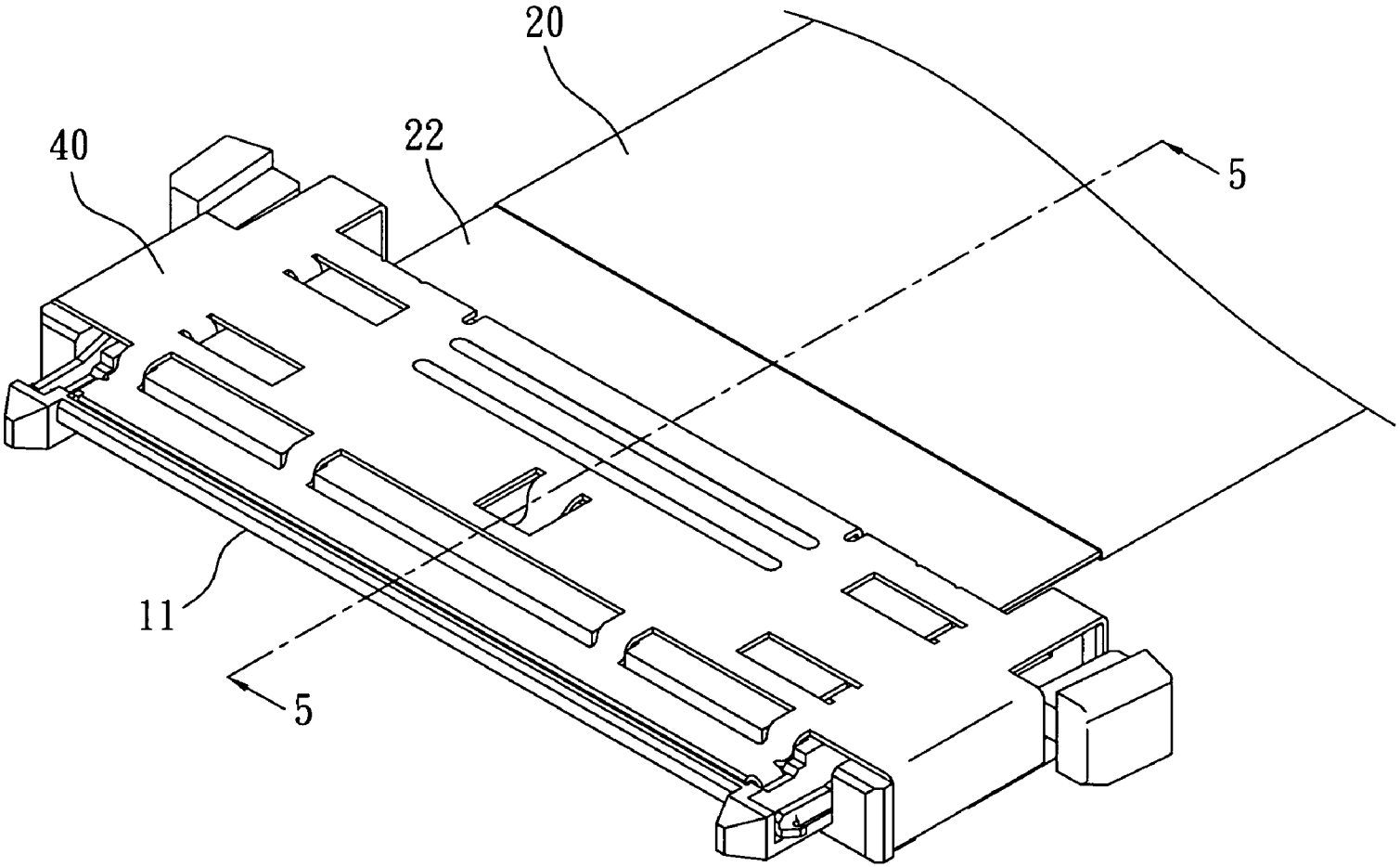
FIG. 2 is a top view of the electrical connector of FIG. 1, wherein the electrical connector is assembled.
Figure 3:
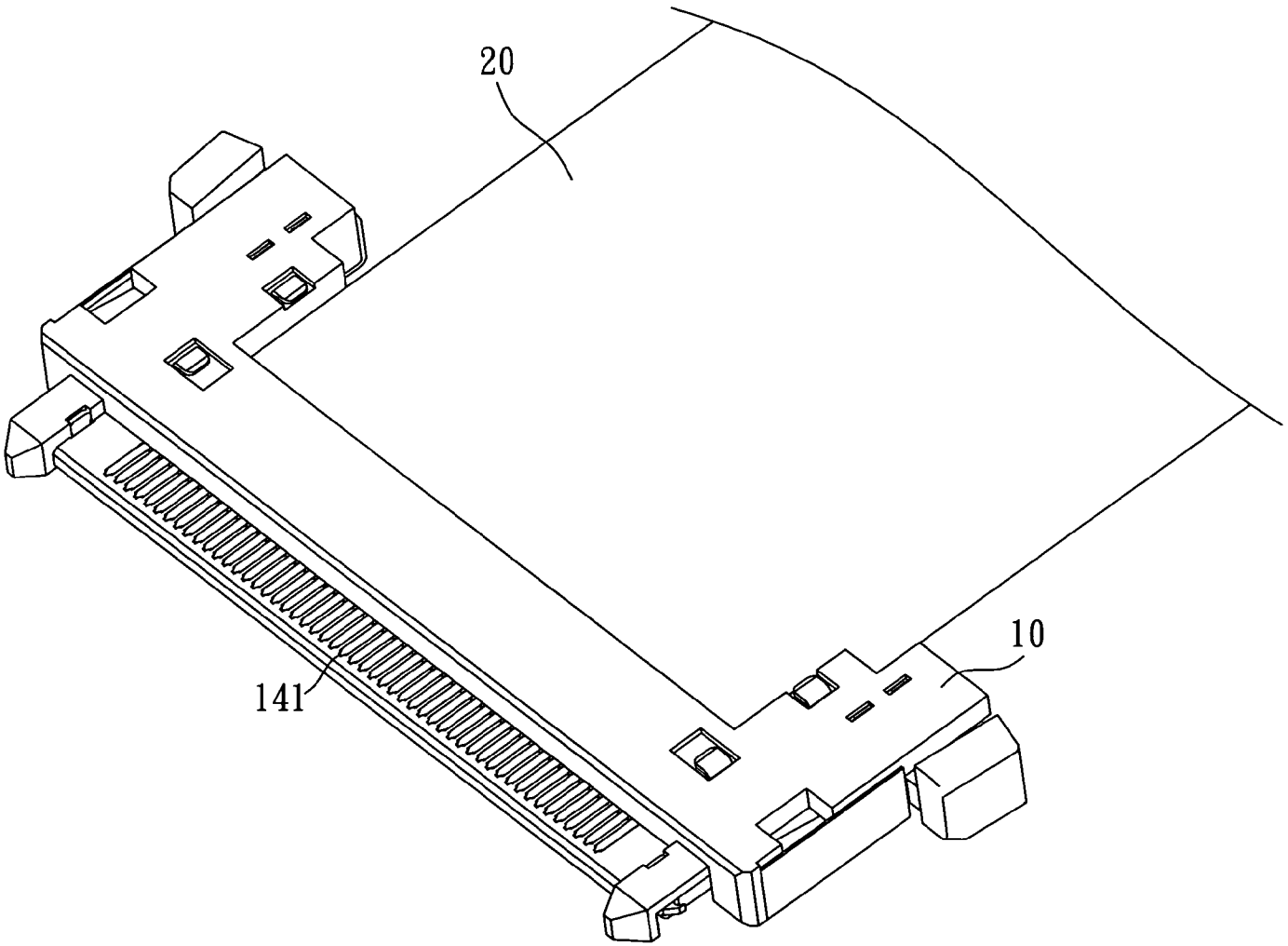
FIG. 3 is a bottom view of the electrical connector of FIG. 2.

Referring to FIGS. 1 to 5, an electrical connector in accordance with the present invention comprises an insulative housing 10, a flexible bus 20 connected to the insulative housing 10, an upper cover 30, and a metal casing 40 shielding the upper cover 30 and fixed to the insulative housing 10.

The insulative housing 10 comprises a mating portion 11 for electrically locking with a mating connector (not shown), and locking portions 12 provided on opposite sides thereof. Each locking portion 12 forms a step portion 13 on an inward side thereof. The step portion 13 has a plurality of lower fixing holes 131 and a plurality of positioning blocks 132. A plurality of terminals 14 are embedded into the insulative housing 10. Each terminal 14 includes a contact portion 141 at an end thereof, and a resilient portion 142 at another end thereof. The contact portion 141 is retained to the mating portion 11, and has a part exposed out beyond a surface of the mating portion 11.

The flexible bus 20 consists of a plurality of conductive wires wrapped by an insulative layer. A plurality of contacts 21 is formed on a surface of an end of the flexible bus 20, and a metal layer 22 is formed on another surface of the flexible bus 20 and opposite the contacts 21.

The upper cover 30 is mounted on the step portions 13 of the insulative housing 10 from top to bottom. The upper cover 30 defines a plurality of upper fixing holes 31 for corresponding to the lower fixing holes 131, and a plurality of recesses 32 for corresponding to the positioning blocks 132. In this way the upper cover 30 is stably positioned relative to the insulative housing 10. The upper cover 30 further defines at least a cutout 33. In assembly, the upper cover 30 presses against the flexible bus 20, forcing the contacts 21 of the flexible bus 20 to contact the resilient portions 142 of the terminals 14 firmly. Before assembly of the upper cover 30, a surface of the flexible bus 20, which is inversed to the surface with the contacts 21 thereon, is glued to the upper cover 30, and then, is together assembled to the insulative housing 10.

Figure 4:
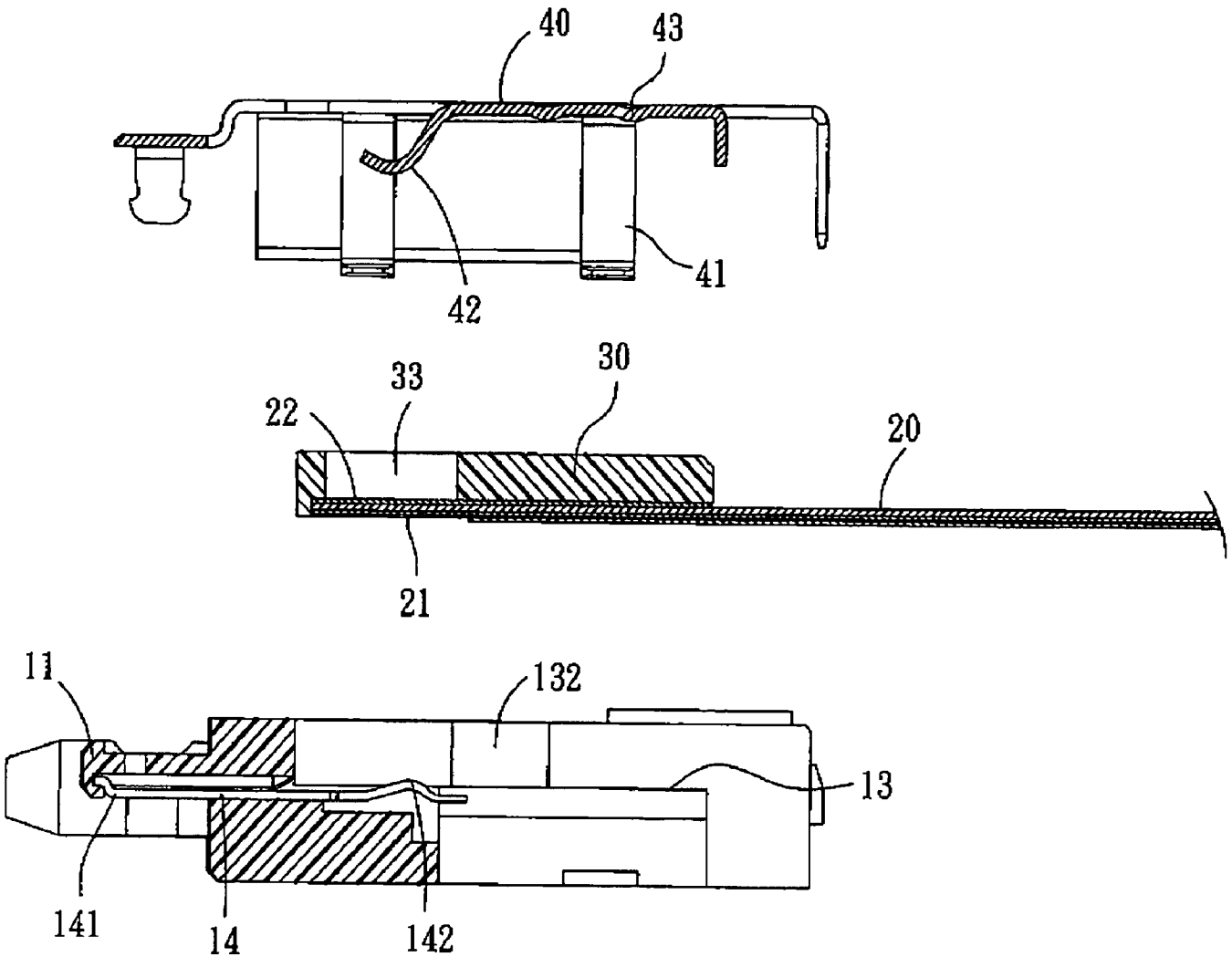
FIG. 4 is a disassembled view of the electrical connector of FIG. 5, wherein the electrical connector is disassembled partly.
Figure 5:
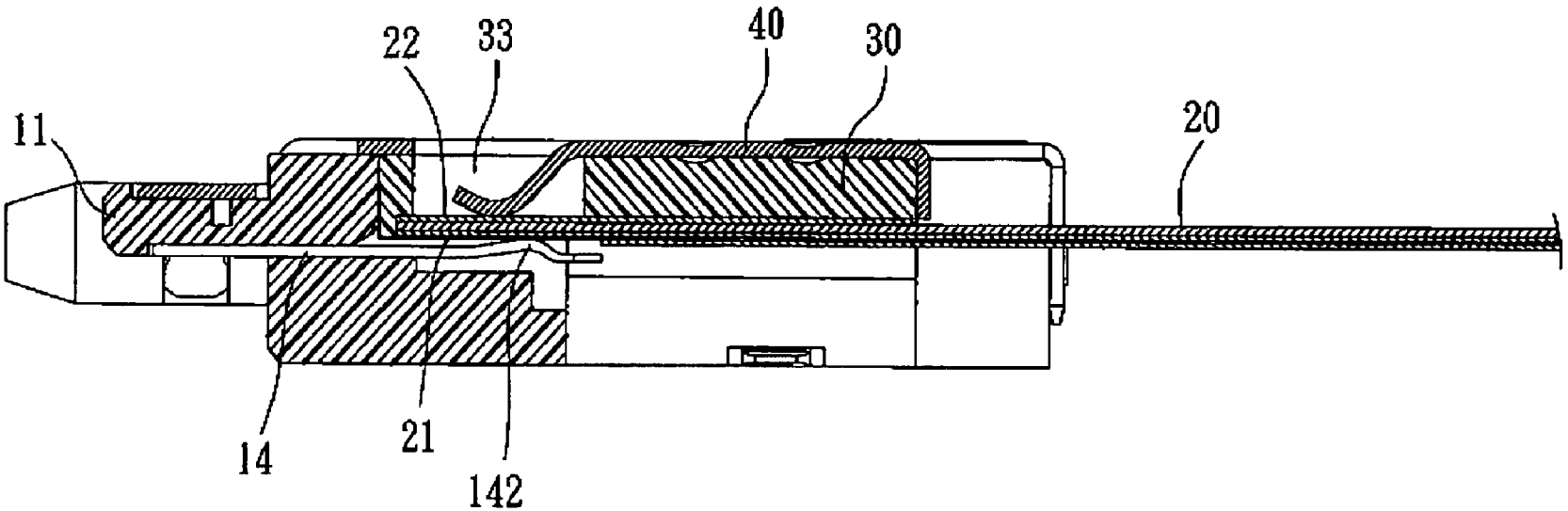
FIG. 5 is a cross-sectional view taken along the line 5-5 of FIG. 2, wherein the electrical connector is assembled.

Referring to FIGS. 4 and 5, the casing 40 has a plurality of fixing sheets 41, at least a spring tongue 42 and ribs 43. The fixing sheets 41 extend through the upper fixing holes 31 and the lower fixing holes 131, and sequentially bend at forward ends thereof for fixing to the insulative housing 10. Thus fixing sheets 41 attach the upper cover 30 to the insulative housing 10 fixedly. The spring tongue 42 extends though the cutout 33 of the upper cover 30 and contacts the metal layer 22 of the flexible bus 20. The electrical connector is thus grounded reliably. The casing 40 biases against the upper cover 30, forcing the contacts 21 of the flexible bus 20 to contact the resilient portions 142 of the terminals 14. The ribs 43 are provided to enhance strength of biasing against the upper cover 30, urging the contacts 21 of the flexible bus 20 to touch the resilient portions 142 of the terminals 14 sufficiently.

Each locking portion 12 of the insulative housing 40 comprises an operation portion 121 at an outward side thereof, a supporting portion 122 adjacent the operation portion 121, and a locking bar 123 accommodated in the supporting portion 122. The locking bar 123 forms a fixing end 124 at an end thereof and beyond an outward side of the mating portion 11. The locking bar 123 forms a projecting portion 125 corresponding to the operation portion 121. In use, the operation portion 121 is pressed, the projecting portion 125 taking the fixing end 124 to move resiliently, thereby engaging with or disengaging from a mating connector (not shown).

As for the present invention, the terminals 14, which have enough strength and precise sizes, are provided to act as an interface between the flexible bus 20 and the mating connector. This design diminishes damage of the contacts 21 of the flexible bus 20 due to repeated plugging. On the other hand, the electrical connector of the present invention is able to accurately mate with a mating connector. In the case that requirements of the transmission system change, for instance, some contacts of the flexible bus 20 have to be removed, the structure of the present invention allows to correspondingly remove some terminals to meet the requirements, which simplifies structure. This is also an advantage of the present invention compared to the prior art.

Figure 6:
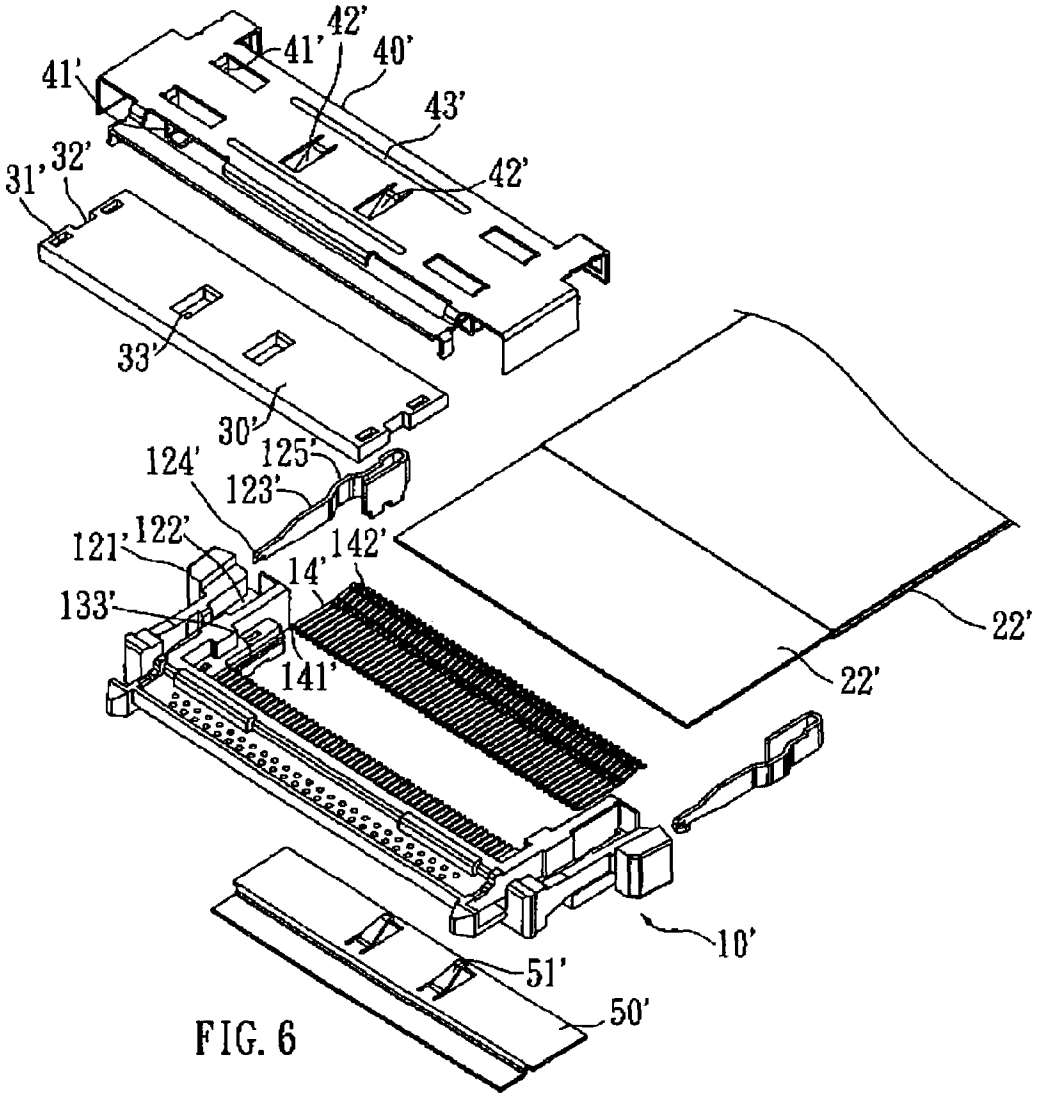
FIG. 6 is an exploded view of an electrical connector according to a second embodiment of the present invention.
Figure 7:
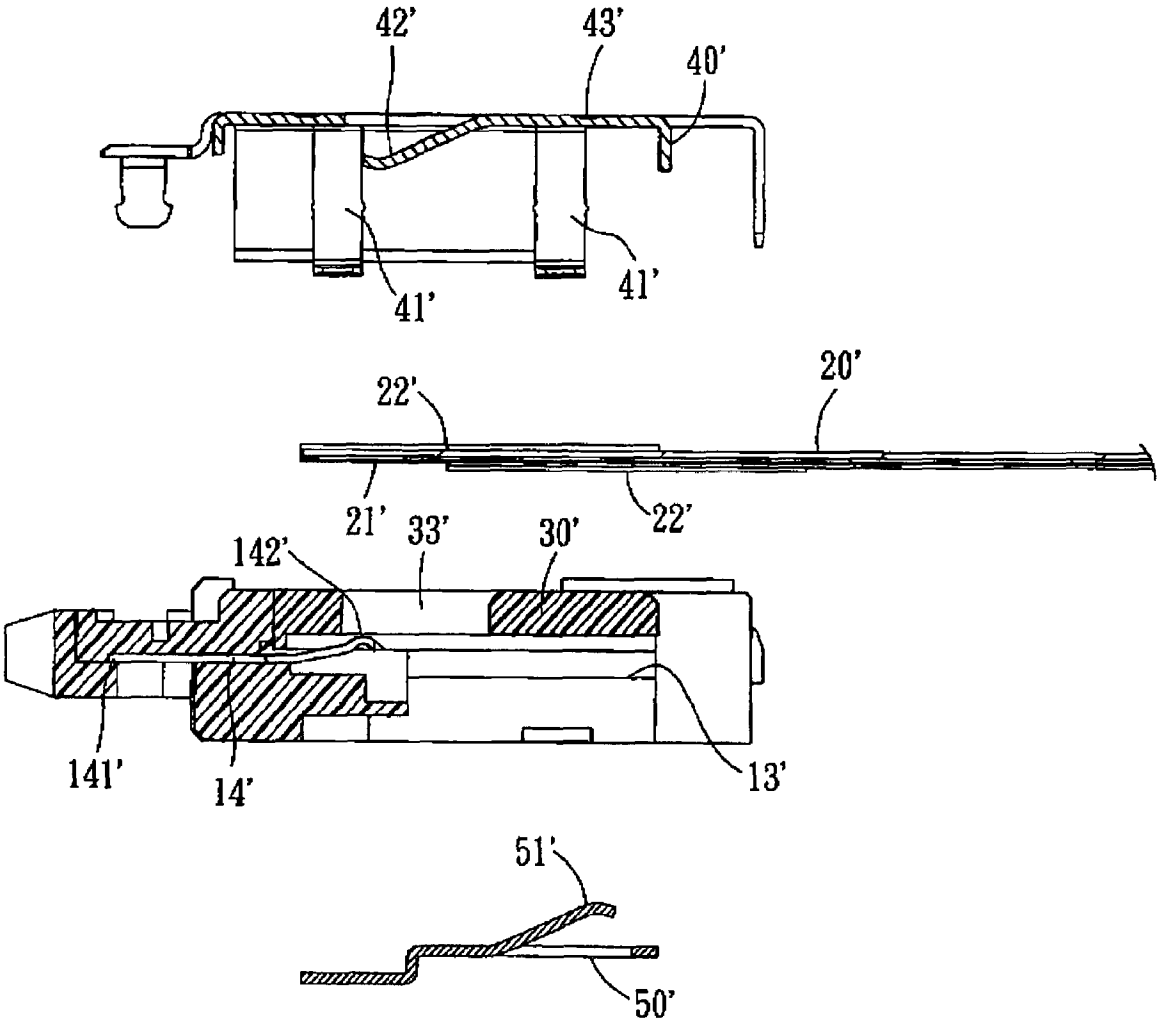
FIG. 7 is a cross-sectional view of the electrical connector of FIG. 6.
Figure 8:
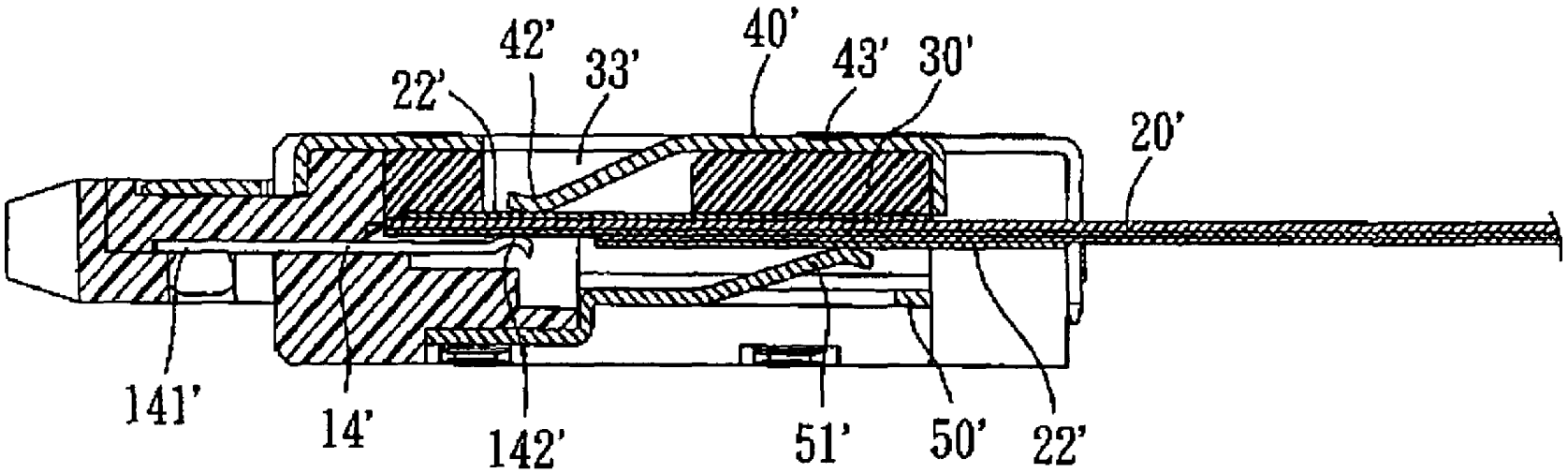
FIG. 8 is a cross-sectional view of the electrical connector of FIG. 6, wherein the electrical connector is assembled.

An electrical connector of a second embodiment of the present invention is particularly adapted for different types of flexible bus. Referring to FIGS. 6 to 8, the electrical connector of the second embodiment comprises an insulative housing 10', a flexible bus 20', an upper cover 30', a casing 40' and a lower metal sheet 50'. The insulative housing 10' comprises a mating portion 11' for electrically locking with a mating connector (not shown), and locking portions 12' provided on opposite sides of the mating portion 11'. Each locking portion 12' forms a step portion 13' on an inward side thereof. The step portion 13' has a plurality of lower fixing holes 131', a plurality of positioning blocks 132', and a guiding groove 133'. A plurality of terminals 14' is embedded into the insulative housing 10'. Each terminal 14' includes a contact portion 141' at an end thereof, and a resilient portion 142' at another end thereof. The contact portion 141' has a part exposed out beyond a surface of the mating portion 11'.

The flexible bus 20' consists of a plurality of conductive wires wrapped by an insulative layer. A plurality of contacts 21' is formed on a surface of an end of the flexible bus 20', and a metal layer 22' is formed on another surface of the flexible bus 20' and opposite the contacts 21'.

The upper cover 30' is mounted on the step portions 13' of the insulative housing 10' from top to bottom. The upper cover 30' has a plurality of upper fixing holes 31' for corresponding to the lower fixing holes 131', and a plurality of recesses 32' for corresponding to the positioning blocks 132'. In this way the upper cover 30' is stably positioned on the insulative housing 10'. The upper cover 30' further defines at least a cutout 33'. In this embodiment, the upper cover 30' is applied to press against the flexible bus 20', forcing the contacts 21' of the flexible bus 20' to contact the resilient portions 142' of the terminals 14' firmly. Before assembly of the upper cover 30', a surface of the flexible bus 20', which is inversed to the contacts 21' of the flexible bus 20', is glued to the upper cover 30', and then, assembled to the insulative housing 10'.

The casing 40' forms a plurality of fixing sheets 41', at least a spring tongue 42' and ribs 43'. The fixing sheets 41' extend through the upper fixing holes 31' and the lower fixing holes 131', and sequentially bend at forward ends thereof. The fixing sheets 41' attach the upper cover 30' to the insulative housing 10' fixedly. The spring tongues 42' extend though the cutout 33' of the upper cover 30' and contact the metal layer 22' of the flexible bus 20'. The electrical connector is thus grounded reliably. The ribs 43' are provided to enhance strength of biasing against the upper cover 30', urging the contacts 21' of the flexible bus 20' to touch the resilient portions 142' of the terminals 14' sufficiently. The casing 40' further has a part extending to the mating portion 11' of the insulative housing 10', and neighboring a surface of the mating portion 11' opposite to the contact portions 141' of the terminals 14'.

The lower metal sheet 50' is assembled to the guiding grooves 133' from a rear of the insulative housing 10'. The lower metal sheet 50' is oriented below the flexible bus 20'. Resilient sheets 51' are protruded from the lower metal sheet 50' and toward the flexible bus 20'. The resilient sheets 51' directly contact the metal layer 22' of the flexible bus 20'. The lower metal sheet 50' also forms contact with the casing 40' for grounding.

In the second embodiment, the metal layer 22' is provided on opposing surfaces of the flexible bus 20'. The metal layer 22' is simultaneously grounded with the spring tongues 42' of the casing 40' and the resilient sheets 51' the lower metal sheet 50' reliably. In other cases, the flexible bus 20' may only have a metal layer 22' on a simple surface thereof, which can be grounded reliably as well. Thus, the electrical connector of the present invention is adapted to different types of flexible bus which has at least a metal layer on any surface. That is, the structure of the electrical connector needs not vary with changes of position of the metal layer.

Figure 9:
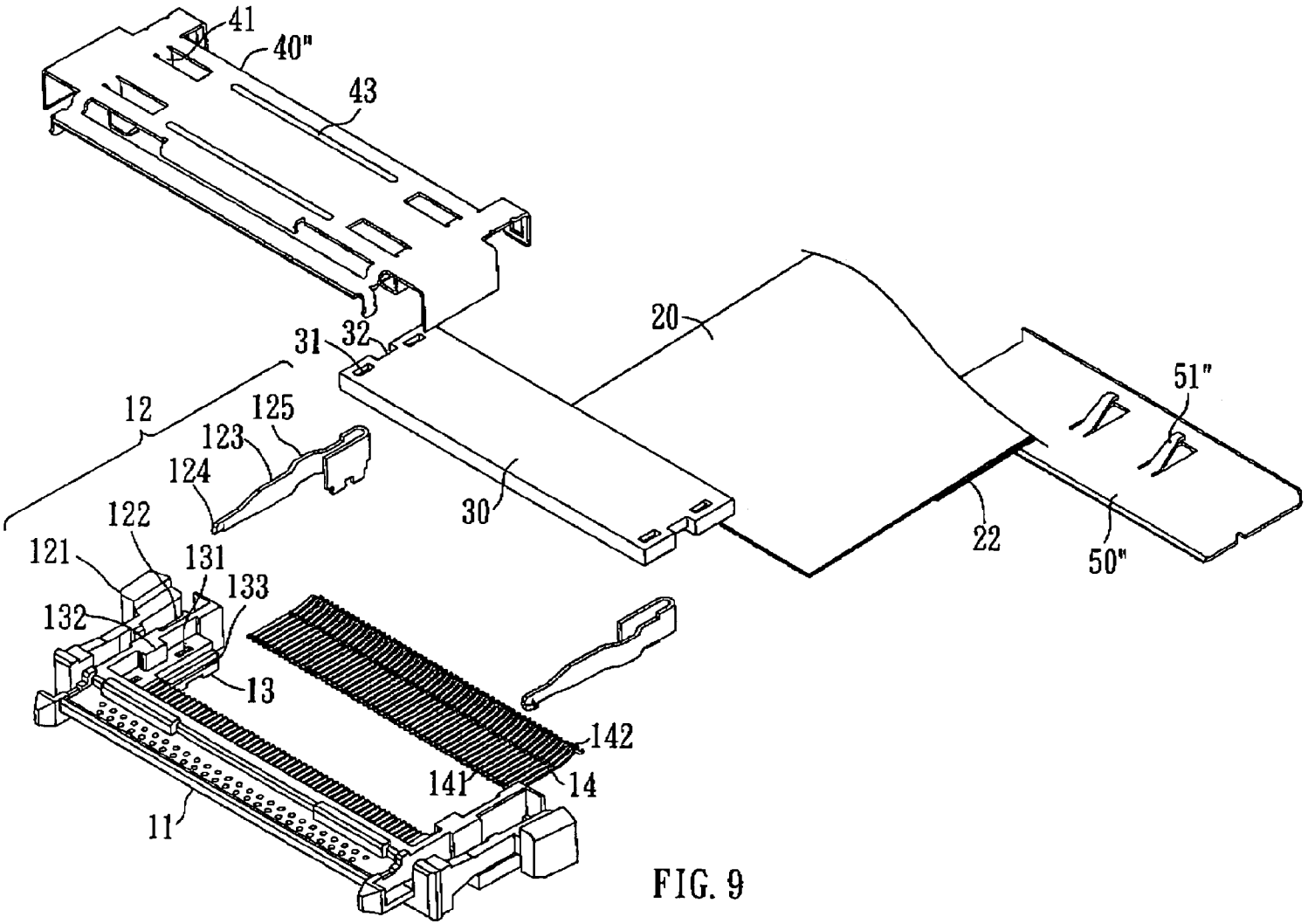
FIG. 9 is an exploded view of an electrical connector according to a third embodiment of the present invention.

FIG. 9 illustrates a third embodiment of the present invention. In the third embodiment, the lower metal sheet 50" forms resilient sheets 51" thereon, while spring tongues of the casing 40" are omitted.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. An electrical connector comprising:

an insulative housing including a mating portion, a plurality of terminals being embedded into the insulative housing, each terminal having a contact portion at an end thereof, and a resilient portion at another end thereof, the contact portion being retained to the mating portion;

an upper cover mounted on the insulative housing;

a flexible bus having a plurality of contacts on an end thereof, the upper cover pressing against the flexible bus in assembly, forcing the contacts to contact the resilient portions of the terminals; and a casing shielding the upper cover and being fixed to the insulative housing, and biasing against the upper cover, forcing the contacts of the flexible bus to contact the resilient portions of the terminals;

wherein the insulative housing has a plurality of lower fixing holes, the upper cover has a plurality of upper fixing holes for corresponding to the lower fixing holes, and the casing has a plurality of fixing sheets extending through the upper fixing holes and the lower fixing holes, and sequentially bending for fixing to the insulative housing.

2. The electrical connector as recited in claim 1, wherein a metal layer is formed on a surface of the flexible bus and opposite the contacts.

3. The electrical connector as recited in claim 2, wherein the upper cover defines at least a cutout, and wherein the casing has at least a spring tongue extending trough the at least a cutout of the upper cover and contacting the metal layer of the flexible bus.

4. The electrical connector as recited in claim 1, wherein locking portions are provided on opposite sides of the insulative housing, each locking portion comprising an operation portion, a supporting portion adjacent to the operation portion, and a locking bar accommodated in the supporting portion.

5. An electrical connector comprising:

an insulative housing including a mating portion, a plurality of terminals being embedded into the insulative housing, each terminal having a contact portion at one end thereof, and a resilient portion at another end thereof, the contact portion being retained to the mating portion;

a flexible bus having a plurality of contacts on an end thereof, each of the contacts respectively contacting the resilient portions of the terminals; and a casing mounted on the insulative housing for preventing the flexible bus from being disengaged from the terminals;

wherein the insulative housing has a plurality of lower fixing holes, the upper cover has a plurality of upper fixing holes for corresponding to the lower fixing holes, and the casing has a plurality of fixing sheets extending through the upper fixing holes and the lower fixing holes, and sequentially bending for fixing to the insulative housing.

6. An electrical connector comprising:

an insulative housing receiving a plurality of terminals therein;

an upper cover mounted on the insulative housing;

a flexible bus having a plurality of contacts on an end thereof, the upper cover pressing against the flexible bus in assembly, forcing the contacts to contact the terminals, a metal layer being formed on a surface of the flexible bus;

a casing shielding the upper cover and being fixed to the insulative housing, and biasing against the upper cover, forcing the contacts of the flexible bus to contact the terminals; and a lower metal sheet assembled below the insulative housing, and forming at least a resilient sheet for contacting the metal sheet of the flexible bus;

wherein the insulative housing has a plurality of lower fixing holes, the upper cover has a plurality of upper fixing holes for corresponding to the lower fixing holes, and the casing has a plurality of fixing sheets extending through the upper fixing holes and the lower fixing holes, and sequentially bending for fixing to the insulative housing.

7. The electrical connector as recited in claim 6, wherein the insulative housing includes a mating portion, each terminal having a contact portion at an end thereof, and a resilient portion at another end thereof, the contact portion being retained to the mating portion.

8. The electrical connector as recited in claim 7, wherein contacts of the flexible bus contact the resilient portions of the terminals.

9. The electrical connector as recited in claim 6, wherein the lower metal sheet contacts the casing.

* * * * *